US008557048B2

(12) United States Patent
Hesterberg et al.

(10) Patent No.: US 8,557,048 B2
(45) Date of Patent: Oct. 15, 2013

(54) METHOD FOR CONTROLLING A FILLING PROCESS OF A WATER-BEARING HOUSEHOLD APPLIANCE

(75) Inventors: Bernd Hesterberg, Heidenheim (DE); Karlheinz Rehm, Dischingen Ortst. Trugenhofen (DE); Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 337 days.

(21) Appl. No.: 12/989,422

(22) PCT Filed: Apr. 8, 2009

(86) PCT No.: PCT/EP2009/054180

§ 371 (c)(1), (2), (4) Date: Oct. 25, 2010

(87) PCT Pub. No.: WO2009/132936

PCT Pub. Date: Nov. 5, 2009

(65) Prior Publication Data

US 2011/0038736 A1 Feb. 17, 2011

(30) Foreign Application Priority Data

Apr. 29, 2008 (DE) ..... 10 2008 021 371

(51) Int. Cl.
*B08B 7/00* (2006.01)
*B08B 7/04* (2006.01)

(52) U.S. Cl.
USPC ..... 134/18; 134/25.2; 134/56 D; 134/57 D; 134/58 D; 68/12.02; 68/12.05; 68/12.19

(58) Field of Classification Search
USPC .... 134/18, 25.2, 56 D, 57 D, 58 D; 68/12.02, 68/12.05, 12.19
See application file for complete search history.

(56) References Cited

U.S. PATENT DOCUMENTS

| | | | | |
|---|---|---|---|---|
| 3,835,880 | A | 9/1974 | Hoffman et al. | |
| 4,334,143 | A | 6/1982 | Cushing | |
| 5,330,580 | A * | 7/1994 | Whipple et al. | 134/18 |
| 5,669,095 | A * | 9/1997 | Dausch et al. | 8/158 |
| 5,768,729 | A | 6/1998 | Cracraft | |
| 2003/0188767 | A1 | 10/2003 | Durfee | |
| 2006/0219262 | A1 * | 10/2006 | Peterson et al. | 134/18 |
| 2007/0163626 | A1 * | 7/2007 | Klein | 134/56 D |
| 2007/0172360 | A1 * | 7/2007 | Teipen | 417/36 |

FOREIGN PATENT DOCUMENTS

| | | | |
|---|---|---|---|
| DE | 19736347 | A1 | 2/1999 |
| DE | 10204003 | A1 | 8/2003 |
| EP | 1593335 | A2 | 4/2005 |

OTHER PUBLICATIONS

Granting Decision RU 2010146790/12 dated Apr. 15, 2013.

* cited by examiner

*Primary Examiner* — Alexander Markoff
(74) *Attorney, Agent, or Firm* — James E. Howard; Andre Pallapies

(57) ABSTRACT

A method for controlling a filling process of a water-bearing household appliance. The method includes opening a locking arrangement to fill the water-bearing household appliance with water, wherein the locking arrangement is controlled by the water-bearing household appliance; monitoring a fill sensor that detects the water flowing into the water-bearing household appliance; activating a pump to convey the water that flowed into the water-bearing household appliance as a result of the absence of at least one signal from the fill sensor; and analyzing a performance characteristic of the pump.

14 Claims, 1 Drawing Sheet

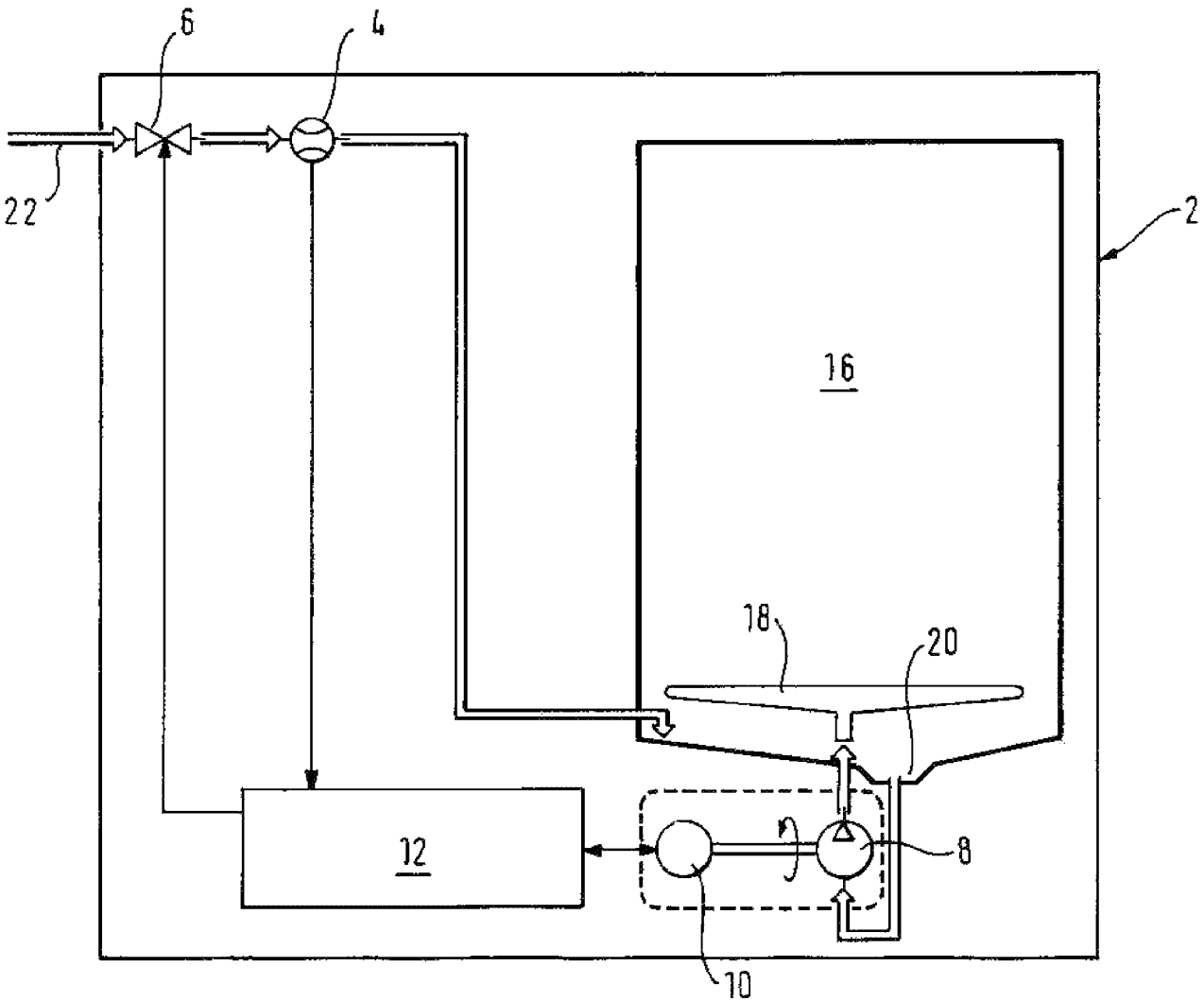
2
16
20
18
8
10
12
4
6
22

METHOD FOR CONTROLLING A FILLING PROCESS OF A WATER-BEARING HOUSEHOLD APPLIANCE

BACKGROUND OF THE INVENTION

The invention relates to a method for controlling a filling process of a water-bearing household appliance, in particular a dishwasher or washing machine.

Water-bearing household appliances, like for instance dishwashers or washing machines, require a minimum quantity of water for their operation. This minimum quantity of water is taken in during a filling step, which is usually at the start of a cleaning program comprising several steps. In the case of a dishwasher, a cleaning program of this type may include the steps, pre-rinse, intermediate rinse, clean, rinse and dry for instance. I.e., during a cycle of a cleaning program of this type, it is necessary to refill water-bearing household appliances with a minimum quantity of water on several occasions.

EP 1 593 335 B1 discloses a dishwasher which has a sensor for detecting water flowing into the water-bearing household appliance and a locking means which can be controlled by the machine, which, in the open state, allows water to flow into the water-bearing household appliance and has a pump for conveying the water flowing into the water-bearing household appliance, with, in the case of an open locking means, the fill sensor being monitored. With the method known from EP 1 593 335 B1, the identification of a total failure of the fill sensor is however not possible.

BRIEF SUMMARY OF THE INVENTION

It is therefore the object of the invention to specify a method, which allows a total failure of a fill sensor to be identified.

The object of the invention is achieved in that the method comprises the following steps:

opening a locking means which can be controlled by the machine for filling the water-bearing household appliance with water, monitoring a fill sensor which detects the inflow of water into the water-bearing household appliance, activating a pump for conveying the water that flowed into the water-bearing household appliance as a result of the absence of at least one signal from the fill sensor, and analyzing the performance characteristic of the pump.

As a result of an activation of the pump taking place after the locking means has been opened and the absence of a signal of the fill sensor, it is possible to determine whether water is flowing into the water-bearing household appliance through the locking means or whether there is a malfunction of the fill sensor. To verify the latter, provision is made to analyze the performance characteristic of the pump, in order to determine whether or not there is water, typically a minimum quantity of 0.5 to 1 l, in the water-bearing household appliance. If this is the case, the fill sensor clearly exhibits a defect, if not, there is a fault in the water supply network, which supplies the water-bearing household appliance with water, for instance a blockage in a supply line.

The inventive method thus makes it easy to establish whether or not the fill sensor of the water-bearing household appliance is functioning correctly and whether it is ending the filling process of the appliance prematurely.

Provision is preferably made here for the locking means to be closed upon analysis of the performance characteristic of the pump, so that an overflow of the water-bearing household appliance is reliably prevented.

Furthermore, provision is preferably made for an optical and/or acoustic error signal, in particular an error signal which can be perceived by an operating person, to be generated upon analysis of the performance characteristic of the pump. This can be done for instance by means of a signal lamp, which is arranged on a control panel of the water-bearing household appliance.

Finally, provision is preferably made for the inflow of water into the water-bearing household appliance to be prevented in the case of a refilling process. It is thus reliably prevented that, in the event of a defective fill sensor, an operating person is able to trigger a refilling process by restarting the water-bearing water device, which may then possibly result in an overflow of the water-bearing household appliance.

The performance characteristic of the pump is preferably evaluated with the aid of the current consumption or current consumption and/or regulating variables of a motor driving the pump.

Provision is preferably made here for the load of the motor driving the pump to be determined with the aid of the evaluated current consumption and/or regulating variable. It is therefore detected and analyzed whether a load increase occurs during operation of the pump as a result of the delivery of water already flowing into the water-bearing household appliance. Instead of the current consumption or current consumption and/or regulating variables of a regulated drive of the pump, other suitable variables can also be used to determine whether water is already to be found in the water-bearing household appliance after opening the controllable locking means.

Provision is preferably made for the pump to be activated in the event of a water quantity which does not ensure the true running of the pump. I.e. the pump is activated in the case of a water quantity flowing into the water-bearing household appliance, which is smaller than a water quantity needed for the true running of the pump. In other words, the pump is operated after opening the locking valve and in the absence of a signal of the fill sensor with a water quantity, in which, in addition to water, air is also taken in by the pump, thereby resulting in an irregular running of the pump. For instance, this may be a water quantity of 0.5 to 1 litre, while 3 to 4 litres of water are needed for a true running of the pump 3.

Provision is also preferably made for the activation of the pump to take place after a time period, in particular a predefinable time period. This thus easily ensures that after opening the locking means and in the absence of at least one signal of the fill sensor, an adequate quantity of water can collect in the water-bearing household appliance, which can be reliably detected by means of an irregularly running pump. The length of the time period is measured according to the time needed to detect the minimally detectable quantity of 0.5 to 1 l. The time period may be between 15 seconds and 1 minute for instance.

Provision is also preferably made for the locking means to be closed after a time period has elapsed, in particular a predeterminable time period and as a result of analysis of the performance characteristic of the pump, so that a further inflow of water is prevented.

Provision is further preferably made for the fill sensor to be an impeller flow meter, thereby providing a particularly simple structure.

Provision is also preferably made for the fill sensor to be arranged in a supply line of the water-bearing household appliance, with the supply line enabling the water-bearing household appliance to be connected to a household water system.

Finally, provision is finally made for the pump to be a circulating pump for circulating liquid in the water-bearing household appliance or a drain pump for conveying liquid out of the water-bearing household appliance.

Finally, a water-bearing household appliance, embodied so as to implement the inventive method, also belongs to the invention,

BRIEF DESCRIPTION OF THE DRAWINGS

The invention is explained below with reference to a drawing, in which;

FIG. 1 shows a schematic representation of a dishwasher.

DETAILED DESCRIPTION OF EXEMPLARY EMBODIMENTS OF THE PRESENT INVENTION

In the present exemplary embodiment, a dishwasher 2 is shown as an example of a water-bearing household appliance.

The dishwasher 2 has a washing compartment 16, into which items to be washed can be introduced in removable crockery baskets arranged inside a washing compartment 16. A spray arm 18 is provided inside the washing compartment 16 in order to apply spray to the item to be washed, with which spray arm the item to be washed can be wetted with liquid and/or washing liquor, i.e. with water displaced with detergent.

The spray arm 18 is connected in a liquid-conducting fashion to a pump 8, which is connected on the intake side with a pump body 20 by way of a line, said pump body being arranged in the bottom region of the washing compartment 16, so that liquid and/or washing liquor dripping downwards from the item to be washed collects in the bottom and thus in the pump body 20 and can be taken in by the pump 8. A motor 10 is provided to drive the pump 8, which may be a BLDC or BLAC motor, in other words an electronically mounted electric motor with permanent magnets, which particularly easily enables load fluctuations in the pump to be detected. The motor 10 is to this end connected to a control facility 12 of the dishwasher 2.

A supply line 22 is provided to fill the dishwasher 2 with water at the start of a cleaning process, said supply line being opened and closed by means of a controllable locking valve 6. To this end, the locking valve 6 is likewise connected to the control facility 12.

A fill sensor 4 is finally connected to the control facility 12, said fill sensor being embodied in the present exemplary embodiment as a wheel sensor. Other suitable fill sensors can however also be used.

At the start of a filling process, the locking valve 6 is opened by the control facility 12, so that water can flow into the washing compartment 16 by way of the supply line 22. At the same time as opening the locking valve 16, the fill sensor 4 is also monitored by the control facility 12. If after opening the locking valve 6, the fill sensor 4 provides a signal representing water flowing through the fill sensor 4, the process is continued until a predetermined quantity in the washing compartment 16 of the dishwasher, 2, for instance 3 to 4 litres of water, has flowed in. It is then possible to continue with a regular further program step, for instance a cleaning step.

If, by contrast, after opening the locking means by the fill sensor 4, no signal is transmitted to the control facility 12, the locking means 6 is held open for a predetermined duration of for instance 15 seconds up to one minute, while a continual check is carried out to determine whether the fill sensor 4 is supplying a signal to the control facility 12. If this time elapses without the fill sensor 4 providing a signal to the control facility 12, the locking valve 6 is then closed again in order to prevent further water from flowing into the washing compartment 16 of the dishwasher 2.

The control facility 12 then activates the motor 10 of the pump 8, in order to circulate water which has already flowed into the washing compartment 16 of the dishwasher 2. The current consumption of the motor 10 is analyzed here by the control facility 12, in order to determine, with the aid of the load of the motor 10, whether or not the pump 8 is circulating water.

If it is determined with the aid of the load of the motor 10 that there is water in the dishwasher 2, in other words water is inside the washing compartment 16, the locking means 6 is closed in order to prevent further water from flowing into the washing compartment 16 of the dishwasher 2. Furthermore, a display (not shown) is activated by the control facility 12, for instance on a control panel, so that an operating person is made aware, by means of an optical error signal, that blockage exists in the dishwasher 2, in particular at the fill sensor 4. Alternatively or in addition, provision can also be made for an acoustic error signal to be generated in addition to the optical error signal.

Finally, the locking valve 6 is permanently blocked by means of the control facility 12, thereby ensuring that, even if a renewed attempt is made to start the dishwasher 2, additional water is not able to flow into the washing compartment 16 of the dishwasher 2, which could result in an overflow of the dishwasher 2.

LIST OF REFERENCE CHARACTERS

| | |
|---|---|
| 2 | Dishwasher |
| 4 | Fill sensor |
| 6 | Locking means |
| 8 | Pump |
| 10 | Motor |
| 12 | Control facility |
| 16 | Washing compartment |
| 18 | Spray arm |
| 20 | Pump head |
| 22 | Supply line |

The invention claimed is:

1. A method for detecting a failure of a fill sensor that detects water flowing into a water-bearing household appliance, the method comprising:

opening a locking arrangement to fill the water-bearing household appliance with water, the locking arrangement controlled by the water-bearing household appliance, the locking arrangement allowing the water to flow into the water-bearing household appliance when the locking arrangement is in an open position;

monitoring the fill sensor, the fill sensor emitting a water-is-flowing signal when the water flows past the fill sensor when the fill sensor is operating properly;

holding the locking arrangement open for a predetermined period of time in response to an absence of the water-is-flowing signal from the fill sensor while the monitoring of the fill sensor is continually performed;

closing the locking arrangement after the locking arrangement is held open for the predetermined period of time and in the absence of the water-is-flowing signal;

after closing the locking arrangement, activating a pump to convey the water that flowed into the water-bearing household appliance, the pump being activated after the locking arrangement is held open for the predetermined period of time;

monitoring a performance characteristic of the pump, the performance characteristic of the pump corresponding to a load of a motor driving the pump;

evaluating the performance characteristic of the pump while the pump is activated after the locking arrangement is held open for the predetermined period of time; and determining that the failure exists in the fill sensor if the performance characteristic of the pump indicates that the pump is pumping water.

2. The method of claim 1, wherein the water-bearing household appliance is one of a dishwasher and a washing machine.

3. The method of claim 1, wherein the locking arrangement is closed as a result of the evaluation of the performance characteristic of the pump.

4. The method of claim 1, wherein at least one of an optical and an acoustic error signal is generated as a result of the evaluation of the performance characteristic of the pump.

5. The method of claim 4, wherein the at least one of the optical and acoustic error signal is perceived by an operating person.

6. The method of claim 1, wherein a subsequent filling process is prevented as a result of the evaluation of the performance characteristic of the pump.

7. The method of claim 1, wherein the performance characteristic of the pump is one of an electrical current consumption and regulating variables of the motor driving the pump.

8. The method of claim 7, wherein the load of the motor driving the pump is determined based on the evaluation of the performance characteristic of the pump.

9. The method of claim 1, wherein the locking arrangement is closed after the predetermined period of time has expired and as a result of the evaluation of the performance characteristic of the pump.

10. The method of claim 1, wherein the fill sensor includes an impeller flow meter.

11. The method of claim 1, wherein the fill sensor is arranged in a supply line of the water-bearing household appliance.

12. The method of claim 1, wherein the pump is one of a circulating pump to circulate liquid in the water-bearing household appliance and a drain pump to convey liquid out of the water-bearing household appliance.

13. The method of claim 7, wherein the performance characteristic of the pump is the electrical current consumption of the motor driving the pump.

14. The method of claim 1, wherein the performance characteristic of the pump is an electrical current consumption of the motor driving the pump.

* * * * *